United States Patent [19]

Dewing

[11] Patent Number: 4,762,438

[45] Date of Patent: Aug. 9, 1988

[54] LIGHTWEIGHT PARKING CURB

[75] Inventor: Kenneth M. Dewing, Porterville, Calif.

[73] Assignee: Dewtek Corporation, Santa Fe Springs, Calif.

[21] Appl. No.: 876,085

[22] Filed: Jun. 19, 1986

[51] Int. Cl.[4] ..... E01F 13/00

[52] U.S. Cl. ..... 404/6; 404/7

[58] Field of Search ..... 404/6, 7, 9; 188/32; 52/102

[56] References Cited

U.S. PATENT DOCUMENTS

| | | | |
|---|---|---|---|
| 2,725,958 | 12/1955 | Porter et al. | 404/6 X |
| 2,935,162 | 5/1960 | Lindsay | 404/6 |
| 3,065,680 | 11/1962 | Wiedman, Sr. | 404/6 X |
| 3,209,662 | 10/1965 | Morton | 404/6 |
| 3,945,747 | 3/1976 | Cruz | 404/7 |

FOREIGN PATENT DOCUMENTS

| | | | |
|---|---|---|---|
| 2337164 | 2/1975 | Fed. Rep. of Germany | 404/7 |
| 2296053 | 7/1976 | France | 404/7 |
| 7704368 | 10/1977 | Netherlands | 404/7 |

*Primary Examiner*—Stephen J. Novosad
*Assistant Examiner*—Matthew Smith
*Attorney, Agent, or Firm*—Christie, Parker & Hale

[57] ABSTRACT

A lightweight, hollow, plastic parking curb is set forth which includes a plurality of downwardly directed converging chambers to receive a pile or adhesive or combination of the two for affixing the curb to a parking surface. The pile may be provided on a fastener configured to be closely driven downwardly into the chamber. Alternatively, a bonding agent may be used to fill the chamber and base positioned recesses which communicate with the chambers.

12 Claims, 3 Drawing Sheets

LIGHTWEIGHT PARKING CURB

FIELD OF THE INVENTION

This invention relates to curbs for vehicular parking lots or the like.

BACKGROUND OF THE INVENTION

In the construction or partitioning of a vehicular parking lot or similar facility, it has been known to provide curbs to delimit, for example, the forward position (or rearward position) of a vehicle in a particular parking space. It has also been known to provide a continuous curb defining the side margins of roadways and the like.

According to the prior art, it has been known to fashion solid, concrete curbs on a mass production basis for this purpose. Each curb is constructed to a desired shape having a longitudinal length of about four feet or so. The curbs, as stated above, are mass produced and stockpiled for future use. Upon demand the concrete curbs are shipped to the side and are fixed to the parking lot surface. The parking surface is usually concrete or asphalt. In most instances, the means by which the heavy curbs are fixed to the parking surface is to drive rods or piles through the holes in the curbs into the surface to fix the curb against lateral and longitudinal movement. The weight of the curb itself prevents vertical movement of the curb.

A drawback of these known, solid concrete curbs is their weight. Since they are solid concrete, stacking heights are limited and heavy equipment must be used for loading, unloading and transporting the curbs. As a result, and primarily due to their weight, installation of such curbs can be expensive.

SUMMARY OF THE INVENTION

There is, therefore, provided according to the present invention a lightweight parking curb which can easily be handled by hand and does not require special handling equipment.

Toward this end, the lightweight parking curb according to the present invention includes a hollow, plastic body preferably roto-molded into the desired configuration. The body has a base to overlay the parking surface and longitudinally extending and upwardly and inwardly projecting sides which terminate at a top. The sides are adapted to engage and restrain movement of the vehicle tire and thereby delimit, for example, an end margin of a parking space. End walls extend upwardly from the base to the top. A plurality of open chambers extend through the body from the top to the bottom. The chambers preferably converge from top to bottom and preferably communicate with upwardly converging recesses in the base.

To fix the curb to the parking surface, means are provided which may include only an adhesive filling the recesses and possibly extending into the chambers to a pile fixed or driven into the surface and extending into the chamber. The pile may according to one embodiment extend through a fastening element through which a pile is driven downwardly into the open chamber, the pile of the fastener penetrating the parking surface to attach the curb thereto. Alternatively, the bonding agent such as an adhesive or cementitious material may be injected into the chamber to secure the plastic body to surface. In another embodiment, to prevent removal of the fastening element, a rod like pile is driven into the parking surface and extends upwardly into the chamber. A suitable bonding agent is thereafter injected into and filling the chamber, and enveloping the pile.

As can be appreciated, the hollow, plastic body is lightweight and hence is susceptible to simplified handling procedures. Greater numbers of such curbs may be transported by any one vehicle to the side and the curbs can easily be manually loaded and unloaded. Further, the means for fixing the curb to the parking surface are easy and straightforward, all of the above features combining to provide an inexpensive means for defining curbs for a parking facility or the like.

BRIEF DESCRIPTION OF THE DRAWINGS

These and other features and advantages of the present invention will become appreciated as the same becomes better understood with reference to the specification, claims and drawings wherein:

DETAILED DESCRIPTION

Figure 1:
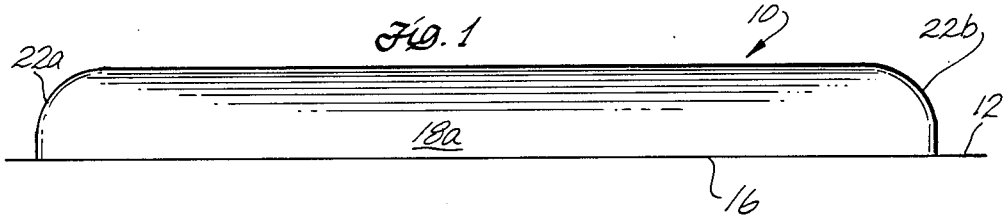
FIG. 1 is a front view of the curb according to the present invention.
Figure 2:
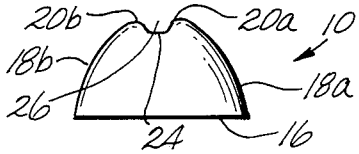
FIG. 2 is an end view of the curb.
Figure 3:
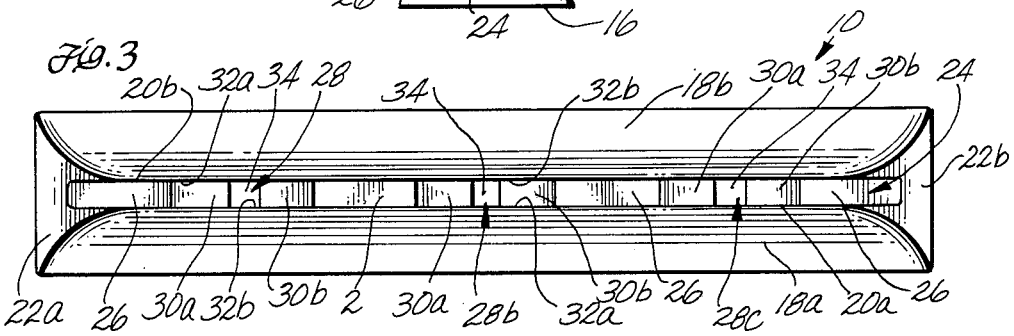
FIG. 3 is a top view of the curb.
Figure 4:
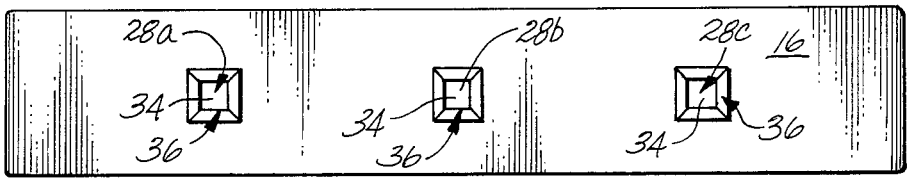
FIG. 4 is a bottom view of the curb.
Figure 5:
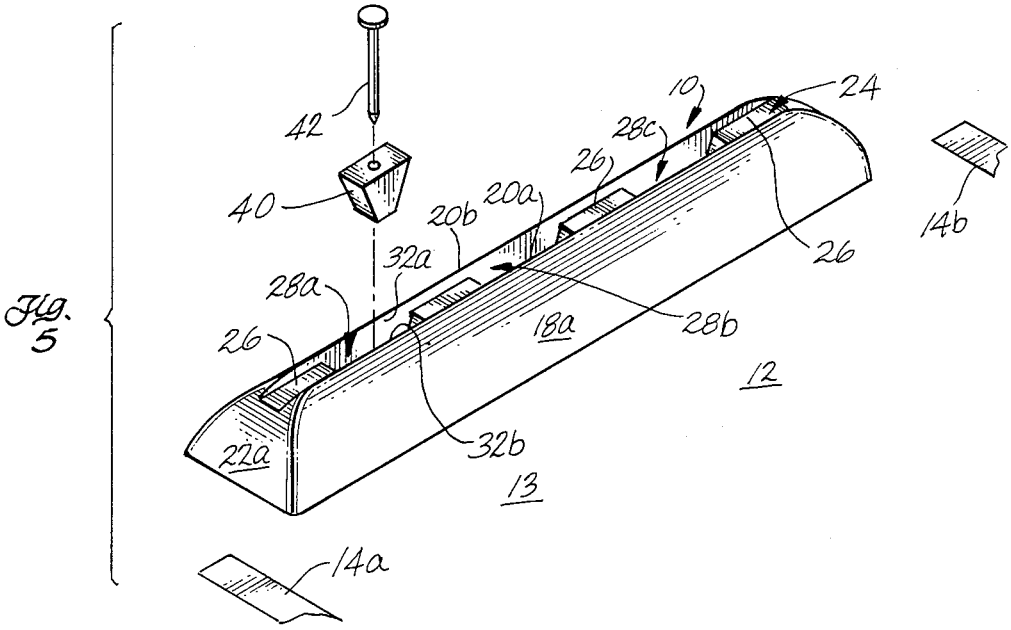
FIG. 5 is a front-top perspective view of the curb.

Turning to the drawings, FIGS. 1–5 illustrate generally the preferred embodiment of a lightweight parking curb 10 according to the present invention. The curb 10 is hollow and preferably fashioned from plastic by any suitable method, preferably roto-molding. In use, the curb 10 is installed on a parking surface 12 which may be a concrete or asphalt surfaced parking lot or the like. As illustrated in FIG. 5, to define a parking space 13, lines 14*a–b* may be applied as by painting on the surface 12, the parking space 13 having one end limit defined by the curb 10. When a vehicle drives into the parking space 13, the vehicle tires will engage the curb 10 to limit the travel of the vehicle in that direction in parking space 13.

The curb 10 is preferably hollow but may be filled, and molded to have a generally flat base or bottom 16 adapted to overlay the surface 12 when the curb 10 is installed. Projecting upwardly and arcuately converging are opposite sides 18*a–b*, which terminate at their upper extent at, respectively, spaced edges 20*a–b*. One or both of the sides 18*a–b* is configured and is adapted to be engaged by the vehicle tire to limit the movement of the vehicle in that direction. Spanning between the sides 18*a–b* and extending upwardly from the bottom 16 are opposite ends 22*a–b*. Completing the general structure of the curb 10 a horizontal extending recessed channel 24 formed of longitudinal segments 26 is provided between the sides 18*a–b* and ends 22*a–b*. The channel 24 is countersunk from the edges 20*a–b*. As can be appreciated, with reference to FIGS. 2 and 5, the channel 24 defined between the edges 20*a–b* is useful for purposes of which will hereinafter become evident.

Figure 6A:
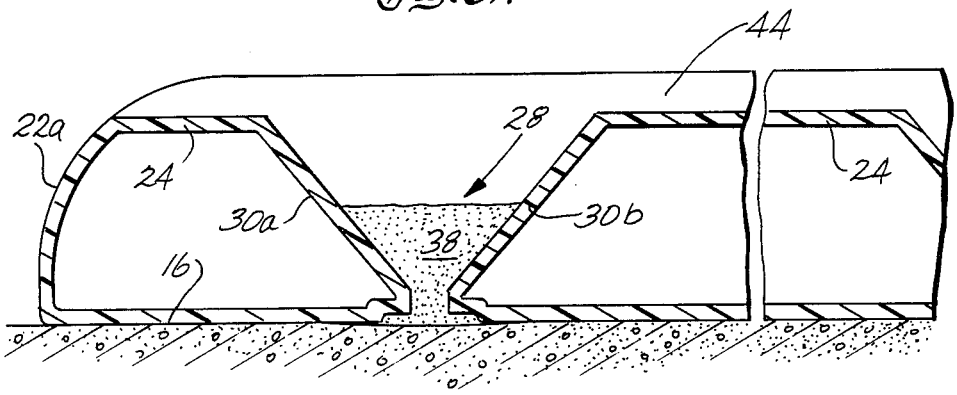
FIG. 6A is a cut side elevation view of a portion of the curb according to the present invention illustrating one embodiment of the means for fixing the curb to the parking surface.
Figure 6B:
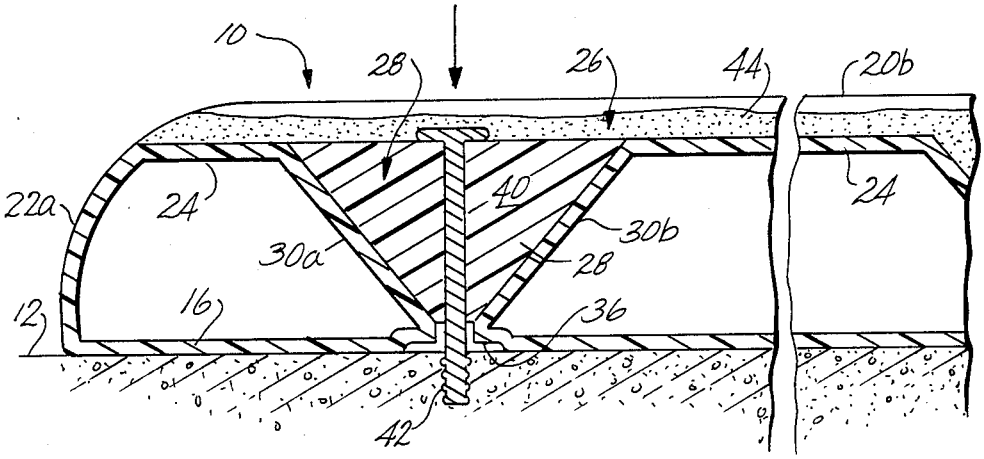
FIG. 6B is a side elevation view of the curb similar to that of FIG. 6A showing another embodiment of the means for fixing the curb to the parking surface.
Figure 6C:
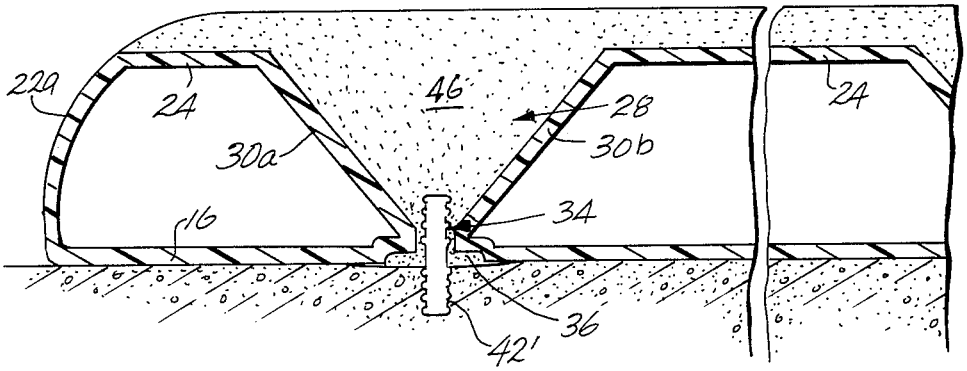
FIG. 6C is a side elevation view of the curb similar to FIGS. 6A and 6B showing still another embodiment of means for fixing the curb to the parking surface.

To provide means for fixing the curb 10 to the surface 12, at least one and preferably a plurality of chambers 28*a–c* extend between the bottom 16 and segments 26. With reference to FIGS. 6A, 6B and 6C, each chamber 28 is generally triangular in cross-sectional configuration having opposed, slopping, converging walls 30*a–b* extending from the longitudinal segments 26 to terminate at or just short of the bottom 16. Triangular partitions 32*a–b* (FIGS. 2 and 5) extend between the walls 30*a–b* defining the triangular chambers 28. With reference to FIG. 4, the aforesaid walls 30*a–b* and partitions 32*a–b* terminate at a rectangular opening 34 which extends between the chambers 28 and provide indented, rectangular recess 36 forming part of the bottom 16. The plastic skin or surface defining the curb 10 is continuous defining the chambers 28 and recesses 36. As formed by rotomolding, the curb 10 is hollow, one-piece and essentially closed to the environment.

Various means enable fixing the curb 10 to the parking surface 12.

With reference to FIG. 6A, securement may simply be by means of an adhesive 40, whether thermoplastic or thermoset which fills recesses 36 and extending as desired into chambers 28. Bonding agents used are similar to that used to bond reflectors and lane buttons to road surfaces. Spikes or similar means are not required.

With·referece to FIGS. 5 and 6B, another means may include a fastening element 40 adapted for insertion into each chamber 28, the element 40 preferably being conformed to be closely received in the chamber 28. A spike or pile 42 extends through element 40 and into the road surface 12. Pile 42 may be or form an integral part of element 40 (not shown). As illustrated in FIG. 6B, when the curb 10 has been appropriately positioned on the parking surface 12, an element 40 containing a pile 42, or a pile 42 extending through element 40, is driven downwardly into each chamber 28 so as to enable insertion of pile 42 into the parking surface 12. The insertion of the pile 42 into the surface 1 is limited by engagement of element 40 with the chamber walls 30*a–b* as is illustrated in FIG. 6B. With the elements 40 thusly inserted into the chambers 28 such that their piles 42 are driven into the parking surface 12, the curb 10 is fixed to the parking surface 12. If desired, and as is shown, a suitable filler 44 may be poured into the recesses 28 to engage the prefixed pile 42 and extend to and fill channels 24 to improve aesthetics and help to prevent removal thereof. The fill may, as shown, lie flush with the edges 20*a–b*.

With reference to FIG. 6C, an alternative method for fixing the curb 10 to the parking surface 12 is illustrated. According to this method, a pile 42′ is inserted into the parking surface 12 either downwardly through each chamber 28 after the curb has been positioned or spaced and located prior to positioning of the curb 10. Each pile 42′ extends upwardly through a passage 34 into a corresponding chamber 28. Thereafter, the adhesive or bonding agent 46 is poured into the chambers 28 enveloping the upstanding portions of the pile 42′ and bonding the curb 10 thereto. The agent 46 also flows from the passageway 34 into the recess 36 spreading out to bond the bottom 16 to the surface 12. Again, if desired, the agent 46 may fill the channel 24 to provide an aesthetically pleasing appearance.

While the curb 10 as shown is hollow, it may, if desired, be filled to increase weight and/or rigidity prior to or at the time of use. The channel may, as desired, only extend between chambers or be eliminated particularly where fill is employed.

A suitable plastic for forming a hollow-curb is cross-linked polyethylene. Solid or hollow curbs may be formed of other materials such as acrylonitrile-styrene-butadiene resins, rubbers and foamed polyolefins.

While I have shown and described certain embodiments of the present invention, it is to be understood that it is subject to many modifications without departing from the spirit and scope of the appended claims.

What is claimed is:

1. A parking curb comprising a light weight hollow plastic body having:
   (a) a rectangular base having edges extending parallel to and edges normal to a longitudinal axis and a top spaced from the base;
   (b) a pair of side walls extending from the edges of the base parallel to the longitudinal axis and converging toward the top;
   (c) a pair or end walls extending from the edges of the base normal to the longitudinal axis and converging toward the top and
   (d) a plurality of chambers extending from the top to the base said chambers providing openings which extend to the base and communicate with recesses extending upwardly from the base, said openings converging in a direction extending from the top to the base.

2. A parking curb as claimed in claim 1, in which a recessed channel extends along the top at least between said chamber.

3. A parking curb as claimed in claim 2 in which the channel extends from end wall to end wall.

4. A hollow parking curb comprising a plastic shell formed of:
   (a) a rectangular base having edges extending parallel to and edges normal to a longitudinal axis and a top spaced from the base;
   (b) a pair of side walls extending from the edges of the base parallel to the longitudinal axis and converging toward the top;
   (c) a pair of end walls extending from the edges of the base normal to the longitudinal axis and converging toward the top; and
   (d) a plurality of chambers extending from the top to corresponding recesses extending and converging upward from the base, each chamber providing an opening extending therebetween and formed of side walls generally parallel to the longitudinal axis and end walls normal to the axis and converging from the top to the recess.

5. A parking curb as claimed in claim 4 in which the top includes a channel which extends from end wall to end wall.

6. A light weight parking curb comprising:
   a hollow, plastic body having a base, top and longitudinally extending upwardly and inwardly projecting sides adapted to restrain movement of a vehicle tire, the body having a plurality of chambers extending from the top to the base, said chambers forming openings which converge in the direction of the base and communicating with recesses extending upwardly from the base; and
   means cooperating with said chambers for fixing the body to a parking surface.

7. A light weight parking curb as claimed in claim 6 in which each chamber is formed of a pair of longitudinally extending pair of parallel walls and a pair of walls normal thereto converging from said top towards said base and communicating with an oppositely converging recess in the base.

8. A light weight curb as claimed in claim 7 in which the means for fixing the curb to the surface includes a bonding agent at least filling the recesses of the base.

9. A light weight curb as claimed in claim 8 in which the bonding agent extends into the chamber.

10. The parking curb of claim 6 wherein the means for fixing the body to a parking surface comprises a pile secured to the parking surface.

11. The light weight parking curb of claim 10 in which the pile extends into and is secured to a bonding agent.

12. The light weight parking curb of claim 6 wherein the fixing means includes a fastening element driven against the converging walls of each chamber by a pile adapted to penetrate the parking surface to fasten the parking curb thereto.

* * * * *